United States Patent [19]

Kurochi

[11] Patent Number: 4,768,765

[45] Date of Patent: Sep. 6, 1988

[54] JIG FOR ARRANGING ELECTRODE PLATES OF AN IONIZATION CHAMBER TYPE X-RAY DETECTOR

[75] Inventor: Haruo Kurochi, Tokyo, Japan

[73] Assignee: Yokogawa Medical Systems, Limited, Tokyo, Japan

[21] Appl. No.: 32,456

[22] Filed: Jun. 27, 1986

[86] PCT No.: PCT/JP86/00336
§ 371 Date: Feb. 19, 1987
§ 102(e) Date: Feb. 19, 1987

[87] PCT Pub. No.: WO87/00295
PCT Pub. Date: Jan. 15, 1987

[30] Foreign Application Priority Data

Jun. 28, 1985 [JP] Japan ..... 60-142238

[51] Int. Cl.[4] ..... B25B 1/20

[52] U.S. Cl. ..... 269/296; 269/58; 269/254 R; 269/37

[58] Field of Search ..... 250/385; 269/37, 43, 269/254 R, 58, 296, 900, 903

[56] References Cited

U.S. PATENT DOCUMENTS

| | | | |
|---|---|---|---|
| 3,201,874 | 8/1965 | Christy | 269/43 |
| 3,834,349 | 9/1974 | Dietze et al. | 269/296 |
| 3,836,135 | 9/1974 | Wightman | 269/43 |
| 4,074,422 | 2/1978 | Börjesson et al. | 269/43 |
| 4,098,046 | 7/1978 | Papa | 269/296 |
| 4,345,156 | 8/1982 | Ishikawa et al. | 250/385 |
| 4,490,614 | 12/1984 | Peerenboom et al. | 250/385 |
| 4,496,842 | 1/1985 | Hermens et al. | 250/385 |
| 4,625,117 | 11/1986 | Hayakawa et al. | 250/385 |

*Primary Examiner*—Frederick R. Schmidt
*Assistant Examiner*—Judy J. Hartman
*Attorney, Agent, or Firm*—Moonray Kojima

[57] ABSTRACT

An electrode plate arranging jig according to the invention which allows to arrange electrode plates with high precision and facilitates the work of constructing an array of electrode plates, characterized in that a member with a plurality of grooves cut at pitches at which the electrodes are arranged has a structure of two superimposed members (11, 12) deviatable from each other in the direction in which the plurality of grooves are arranged, and has grooves (13, 14) having a width which has enough leeway compared to the thickness of the electrode plates.

2 Claims, 4 Drawing Sheets

JIG FOR ARRANGING ELECTRODE PLATES OF AN IONIZATION CHAMBER TYPE X-RAY DETECTOR

TECHNICAL FIELD

The invention relates to improvements to an electrode plate arranging jig used for positioning a plurality of electrode plates in an ionization chamber type X-ray detector for a computer tomograph when the detector is constructed.

BACKGROUND ART

As is well known, an ionization chamber type X-ray detector of a computor tomograph has a structure shown in FIG. 4. Namely, the X-ray detector includes, within a sealed casing in which an xenon gas, etc., are enclosed, an array of electrode plates 34 of a plurality of signal electrode plates 3 (hereinafter referred to as the anode) and a plurality of bias electrode plates 4 (hereinafter referred to as the cathodes) which are alternately disposed parallel to the direction of the arrow 5 in which a fan beam X-ray enters. The front 2 of the casing 1 has an X-ray entrance window made of a material, highly transparent to X-rays, for example, of a thin aluminum film. The casing 1 has an arcuate shape with the X-ray entrance window on its inner side. The anode 3 are individually connected to current sensors circuit (not shown) while all the cathodes 4 are connected together to the output terminal of a direct current power source (not shown).

The array of electrode plates 34 in such an ionization chamber type X-ray detector has a structure such as that shown in FIG. 5. FIG. 5 shows the array of electrode plates 34 in a cross-sectional view taken along the arcuation of the X-ray detector. As shown in FIG. 5, the anode 3 and cathodes 4 are bonded, for example, by an epoxy bond 7 between two insulator support plates 6, for example, of ceramic.

In manufacturing such array of electrode plates 34, an electrode plate arranging jig is used in order to arrange anode 3 and cathodes 4 properly. The jig has an inner member which has a curved surface along the inner side of the finished arcuation of the array of electrode plates 34, the curved surface having thereon a plurality of grooves cut to pitches at which the electrode plates are arranged, and an outer member having a curved surface along the outer side of the finished arcuation of the array of electrode plates 34, the curved surface having a plurality of grooves cut to pitches at which the electrode plates are arranged, with the curved surfaces opposing at a predetermined spacing.

A predetermined arrangement of the electrode plates is obtained by inserting anode 3 and cathodes 4 alternately into the grooves cut on the two opposing curved surfaces of a jig such as that mentioned above in the space between the curved surfaces. Under this condition, an insulator support plate 6 is bonded to each of the upper and lower ends of the row of electrode plates to form the array of electrode plates 34. The jig is removed from the array of electrode plates 34 after the bond is completely hardened.

Preferably, the width of each of the electrode insertion grooves in the jig is as close as possible to each electrode plate in order to enhance the accuracy with which the electrode plates are arranged. However, in order to facilitate the work of inserting electrode plates having variations in thickness and the work of removing the jig from the arcuate finished array of electrode plates 34, it is necessary that the groove width has proper leeway compared to the thickness of the electrode plates. Thus, the prior art jig does not necessarily provide a satisfactory precision with which the electrodes are arranged.

DISCLOSURE OF THE INVENTION

It is an object of the invention to provide an electrode plate arranging jig which allows to arrange electrode plates with high precision and facilitates the work of constructing an array of electrode plates.

An electrode plate arranging jig according to the invention is characterized in that a member having a plurality of grooves cut to the pitches at which the electrodes are arranged has a structure in which two superimposed members (11, 12) can be deviated from each other in the direction in which the grooves are arranged, and that the grooves (13, 14) have a width having enough leeway compared to the thickness of the electrode plates.

BRIEF DESCRIPTION OF THE INVENTION

FIGS. 1(A) and (B) are views showing the essential portion of an electrode plate arranging jig of one embodiment of the present invention;

FIGS. 2(A) and (B) illustrate the positioning of the electrode plates by an electrode plate arranging jig of the embodiment of the present invention;

BEST MODE FOR CARRYING OUT THE INVENTION

The present invention will now be described in detail with reference to the drawings.

Figure 1A:
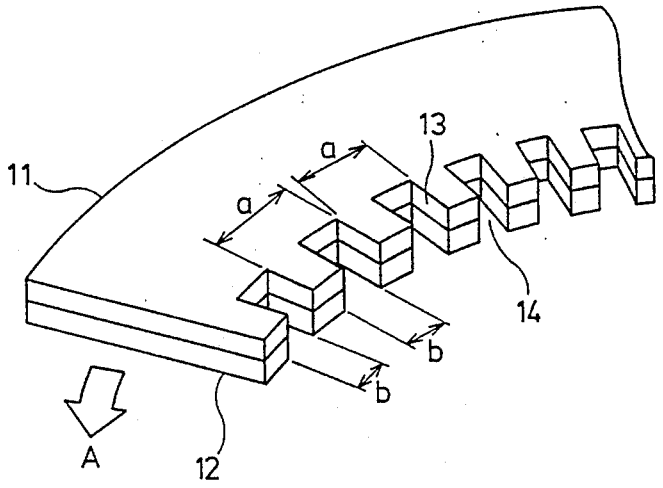
Figure 1B:
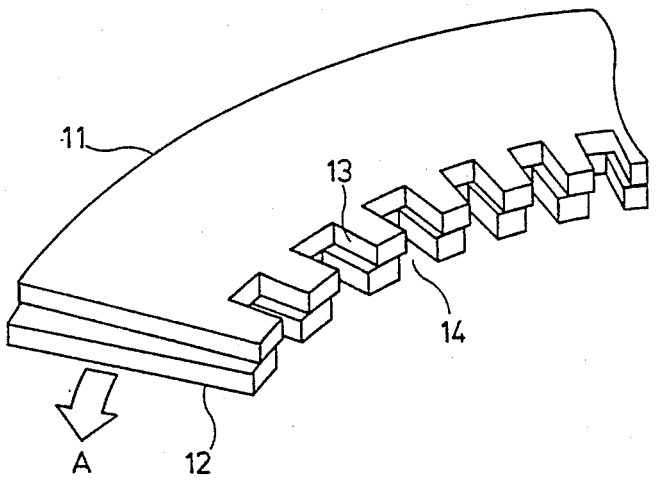

FIGS. 1 (A) and (B) illustrate the essential portion of an electrode plate arranging jig of one embodiment of the present invention. These Figures show part of an outer member of the jig. The outer member has a two-superimposed structure of a first member 11 and a second member 12 which have a plurality of grooves 13 and 14 cut at predetermined pitches a on their curved surface along the outer arcuation of the array of electrode plates. The width b of grooves 13 and 14 is selected to be so large as to have enough leeway compared to the thickness of the electrode plates. Any one of first and second members 11 and 12 (for example, first member 11) is fixed while the other (for example, second member 12) is movable in the direction of arrow A in which the grooves 13 and 14 are arranged. FIG. 1 (B) shows the state where the second member 12 is moved.

Such an outer member is supported by proper support means. Two or more upper and lower outer members with aligned grooves may be provided.

An inner member, not shown, has a similar structure. It has a grooved curved surface facing the outer member and is supported by support means at a predetermined spacing from the outer member. Under this condition, the fixed members in the outer and inner members fix the outer and inner members so that the grooves in one of the outer and inner members properly align those in the other in one-to-one correspondence.

Fabrication of the array of electrode plates is performed as follows, using a jig having a structure such as that mentioned above.

Figure 2A:
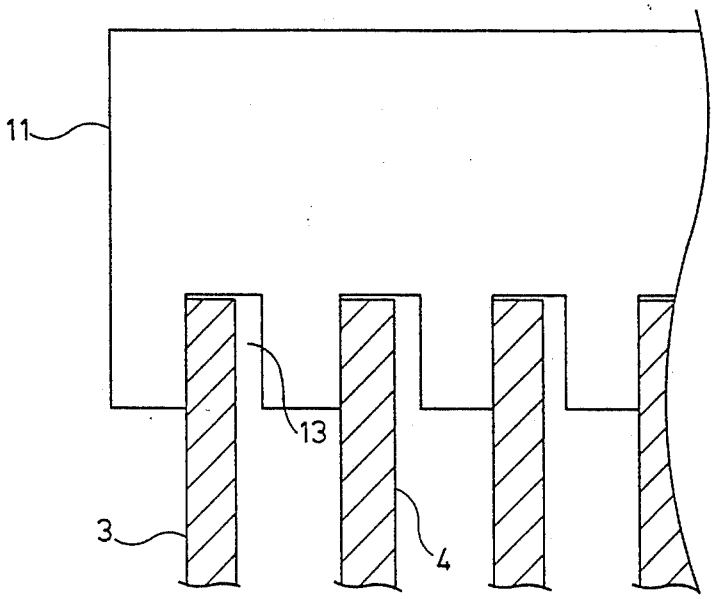
Figure 2B:
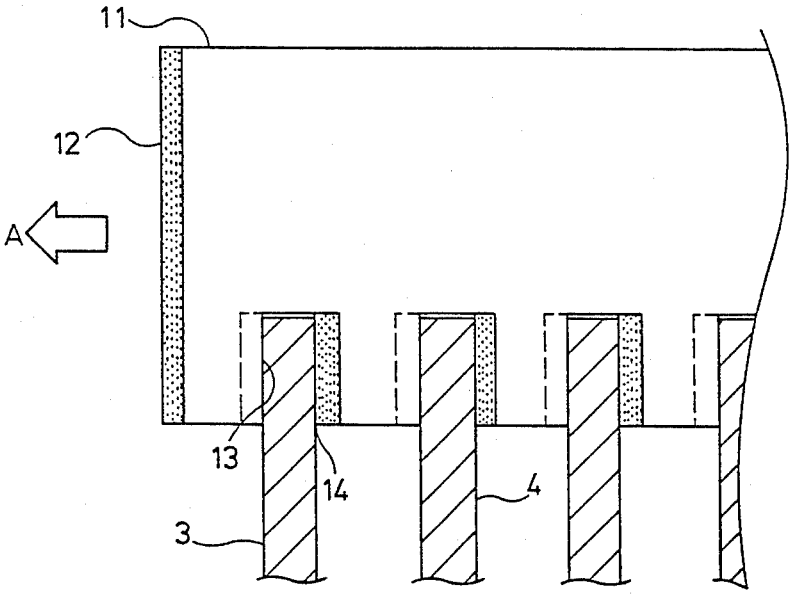

First, in the outer and inner members, the movable members are aligned in position with the fixed members. Under this condition, as shown in FIG. 2 (A), anode 3 and cathodes 4 are individually inserted into grooves 13 (grooves 14 are also aligned with grooves 13). This insertion of these electrode plates can easily be performed because the groove widths are so large as to have enough leeway compared to the thickness of the electrode plates. After all the anode 3 and cathodes 4 to be inserted are inserted into grooves 13, the movable or second members 12 of both the outer and inner members are slid in the direction of the arrow A so as to cause the groove 14 sides to push the electrode plates to the respective opposite sides of grooves 13, as shown in FIG. 2(B). This causes the surfaces of anode 3 and cathodes 4 to be positioned relative to one side wall of grooves 13 (in the Figure, the left side wall). With this condition being maintained, an insulator support plate is bonded to each of the upper and lower end of the row of electrode plates. After the bond has fully hardened, the second members 12 are pulled back until the grooves 14 align with grooves 13 so as to return to the state of FIG. 2(A). The outer and inner members are then removed from the support means to separate the finished array of electrode plates from the jig. At this time, removal of the jig can easily be performed because the groove width is so large as to have enough leeway compared to the thickness of the electrodes.

Figure 3:
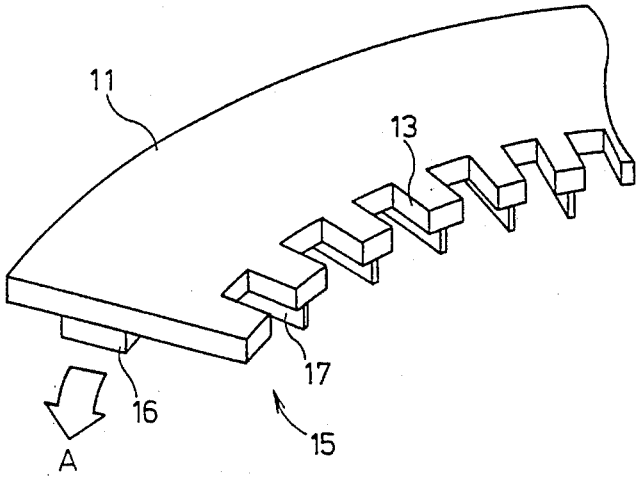
FIG. 3 is a view showing the essential portion of an electrode plate arranging jig of another embodiment of the present invention.
Figure 4:
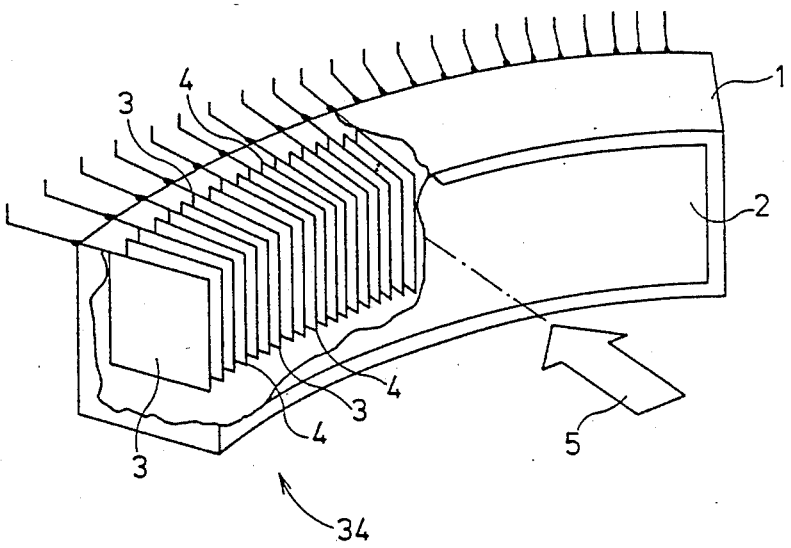
FIG. 4 shows an ionization chamber type X-ray detector.
Figure 5:
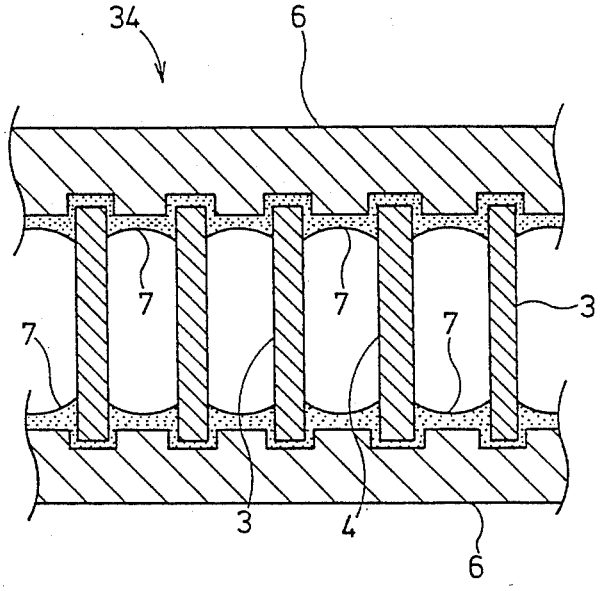
FIG. 5 illustrates an array of electrode plates.

FIG. 3 shows the essential portion of an electrode plate arranging jig as another embodiment of the present invention. This embodiment is characterized in that a movable member 15 includes a connection portion 16 by which the member 15 is slidable relative to a fixed member 11 in the direction of the arrow A, and leaf springs 17 fixed to the connection portion 16 at the same pitch as grooves 13.

In an electrode plate arranging jig having a structure such as mentioned above, movable members 15 can be manipulated in the same manner as the second members 12 in the first embodiment to push the surfaces of the electrode plates, inserted into grooves 13, against one side of grooves 13 using leaf springs 17 or to release the pushing. Thus an electrode plate arranging jig which functions in a manner similar to that of the first embodiment is provided.

While the best mode for carry out the invention has been described, many changes and modifications may easily be made by those having an ordinary knowledge of the art to which the invention belongs without departing from the accompanying claims.

I claim:

1. A jig for arranging a plurality of flat electrodes along radial lines emanating from a center point, said jig comprising a first flat plate defined by two flat surfaces and concentric inner outer circular edges, said circular edges having their centers at a common center point, said first plate having a plurality of slots cut into its inner circular edge with each slot having the same predetermined width and located at the same predetermined distance from one another and extending inward from said inner circular edge in lines radially emanating from said common center; said first plate being held stationary; and a second flat plate defined by two flat surfaces and concentric inner outer circular edges, said circular edges having their centers at a common center point, said second plate having a plurality of slots cut into its inner circular edge with each slot having the same predetermined width and located at the same predetermined distance from one another and extending inward from said inner circular edge in line radially emanating from said common center; said second plate being disposed with one of its flat surfaces against one of said flat surfaces of said first plate with the respective plurality of slots of said first plate being aligned with the plurality of slots of said second plate, in one condition; said second plate being movable with respect to said first plate so that respective ones of said plurality of slots of said first plate are positioned to have only part of each said slot aligned with the respective slot of said second plate, in a second condition;

whereby, in said one condition, said plurality of flat electrodes are placed within the aligned slots of said first and second plates to contact only one side of the slots of said plates and then after relative movement of the first and second plates, in said second condition, the electrodes contact one side of said slots of said second plate which is opposite to the said one side of said slots of said first plate, whereupon said electrodes are grippingly held in alignment between said plates.

2. A jig for arranging a plurality of flat electrodes in lines radially emanating from a center point, said jig comprising a flat first plate defined by two flat surfaces and concentric inner outer circular edge, said circular edges having their centers at a common center, said first plate having a plurality of slots cut into the inner circular edge with each slot having the same predetermined width and located at the same predetermined distance from one another and extending inward from said inner circular edge in lines radially emanating from said common center, said first plate being held stationary; and a second plate comprising a movable bar and attached thereto a plurality of flat springs disposed at said predetermined distance from each other, said second plate being disposed under one flat surface of said first plate with said plurality of springs being located between respective ones of said slots of said first plate, in one condition; and said bar being movable to move said flat springs to be directly under respective ones of said slots, in a second condition;

whereby a plurality of flat electrodes are placed within the slots of said first plate, in one condition, to contact only one side of said slots; and then, after relative movement of said bar of said second plate, in a second condition, the springs are moved to be against said flat electrodes, whereupon said electrodes are grippingly held in alignment between said plate and said springs.

* * * * *